United States Patent [19]

Robin et al.

[11] 4,307,685

[45] Dec. 29, 1981

[54] HEAT EXCHANGER AND ESPECIALLY A SODIUM-HEATED STEAM GENERATOR

[75] Inventors: Marcel Robin, Sevres; Jean Tillequin, Paris, both of France

[73] Assignees: Commissariat a l'Energie Atomique; Creusot Loire, both of Paris, France

[21] Appl. No.: 81,433

[22] Filed: Oct. 3, 1979

Related U.S. Application Data

[63] Continuation of Ser. No. 828,977, Aug. 29, 1977, abandoned.

[30] Foreign Application Priority Data

Sep. 3, 1976 [FR] France ..... 76 26618

[51] Int. Cl.[3] ..... F22B 1/06; F28F 9/02

[52] U.S. Cl. ..... 122/32; 165/158; 165/134 R

[58] Field of Search ..... 165/161; 122/32, 34

[56] References Cited

U.S. PATENT DOCUMENTS 1,641,999 9/1927 Webster ..... 165/161

3,628,507 12/1971 Saporiti ..... 122/32

3,768,554 10/1973 Stahl ..... 165/160 X 4,029,055 6/1977 Haese ..... 122/32

FOREIGN PATENT DOCUMENTS 41405 5/1913 Sweden .

*Primary Examiner*—Samuel Scott

*Assistant Examiner*—Theophil W. Streule, Jr.

[57] ABSTRACT

The heat exchanger comprises a vertical outer cylindrical shell of substantial length, a distributor for supplying the internal space of the shell with liquid sodium, at least one tube bundle placed within the shell for circulating water in heat-exchange relation with the sodium and means for maintaining an inert gas atmosphere above a predetermined free level of liquid sodium. The top and bottom tube ends are fitted with thermal sleeves for joining them to the lateral wall of the shell and passing them through this latter. The distributor is placed within the shell above the tube bundle between the top end of said bundle and the free level of liquid sodium.

9 Claims, 4 Drawing Figures

HEAT EXCHANGER AND ESPECIALLY A SODIUM-HEATED STEAM GENERATOR

This is a continuation, of application Ser. No. 828,977, filed Aug. 29, 1977, now abandoned.

This invention relates to a heat exchanger and more especially to a steam generator which is heated with liquid sodium.

A number of different designs of sodium-heated steam generators are already known, especially in nuclear installations of the fast reactor type. In a conventional design, a generator of this type is constituted by an outer cylindrical shell having a vertical axis and supplied with liquid sodium, at least one bundle of vaporization tubes being placed within the shell. These tubes are arranged either in the form of snaked coils or in spirals having straight end portions which are intended to be fixed either on tube-plates which are integral with the shell or on tube-plates or headers located outside said shell. In the case last mentioned, the tubes pass individually through the shell wall and each end portion of a tube is advantageously fitted with a thermal sleeve which serves to joint the tube to the wall in order to permit a leak-tight penetration and to withstand differential expansions.

Another known practice consists in maintaining an atmosphere of inert gas such as argon, for example, above a free level of liquid sodium within the heat-exchanger shell. The end portions of the tubes through which the steam is circulated accordingly traverse the shell wall within the argon "sky" which is formed by the above-mentioned atmosphere.

In the event of steam leakage into the argon "sky", corrosive deposits of sodium hydroxide are liable to form on the heat-exchanger tubes since the vapor pressure of sodium within the argon is not negligible. In order to remove such deposits, it is necessary to make use of the sodium in order to wash the surfaces of the end portions of the tubes as well as the surfaces of the thermal sleeves of these latter. A washing operation of this type calls for an increase in the level of liquid sodium, for a concomitant reduction in volume of the argon "sky" and for relatively long and complicated operations during which corrosion of the tubes is liable to continue. Moreover, the surfaces of these straight tube sections which are located within the argon "sky" do not take part in the heat exchange between the sodium and the water to be vaporized, thereby impairing the efficiency of the generator. The heat-exchanger tubes must also be suitably braced at the level of their straight portion and this has the effect of complicating the structure of the generator.

This structure is further complicated by the fact that the tubes must be suitably arranged to provide passages for the supply of liquid sodium which is usually admitted into the upper portion of the outer shell through inlet nozzles connected to an axial distributor. The tubes of the bundle must therefore be arranged on each side of the nozzles or passed around these latter if necessary.

The aim of the present invention is to overcome the disadvantages mentioned in the foregoing while additionally ensuring a more simple constructional design of the steam generator as well as a more uniform distribution of the liquid sodium as this latter is admitted into the outer shell of the steam generator. The generator under consideration is accordingly distinguished by the fact that the distributor is placed within the outer shell above the tube bundle between the upper end of said bundle and the free level of the liquid sodium.

The tubes of the bundle are thus continuously immersed in the sodium over their entire length. This accordingly permits carrying out a more rapid detection of small leakages which can occur only in a mass of sodium, the hydrogen concentration of which is permanently checked by a detector on the one hand, and on the other hand in the event of any fault or accident condition, this accordingly makes is possible to carry out integral washing of said tubes and dispenses with the need for any special washing operation in the argon "sky" region. Furthermore, enhanced efficiency of the generator is achieved by virtue of the fact that the entire surface of all the tubes takes part in the heat-exchange process. Furthermore, the structure of the steam generator is considerably simplified. The straight end portions of the tubes can be reduced in length since no special bracing is necessary at this level. Another particularly important advantage arises from the fact that a free space is made available between the level of penetration of the tubes through the outer shell and the liquid sodium level at the top end of said shell. This space is advantageously employed for the purpose of accommodating the liquid sodium distributor. A distributor of this type can be designed in particular in an annular form since there is nothing to prevent or even to complicate a design of this type under such conditions. A distinct improvement in the distribution of the liquid sodium is consequently achieved.

As an advantageous feature, the vaporization tubes pass through the lateral wall of the outer shell at a number of different levels distributed over a relatively small length of said shell. Moreover and in accordance with a distinctive feature of the invention, the distributor is constituted by a chamber of annular shape which is coaxial with the outer shell and supplied through at least one nozzle which is joined to the lateral wall of the outer shell, said chamber being intended to communicate with the internal space of said shell.

In accordance with a preferred alternative embodiment, the annular chamber of the distributor is supplied through two independent and diametrically opposite nozzles having a common horizontal axis and having their openings respectively in two adjacent compartments formed within the chamber on each side of a vertical transverse partition-wall which contains the axis of the outer shell and extends at right angles to the nozzles aforesaid, each compartment being in turn divided into a plurality of adjacent sectors delimited by bent-back sheet-metal elements attached to the distributor and arranged in pairs with the chamber opposite to the nozzle which opens into a compartment so as to form separate ducts for the distribution of the sodium flow.

In addition, the distributor chamber preferably has a cylindrical central shell in coaxial relation with the outer shell and provided with an upward extension limited by a top end-wall which closes said outer shell and against which said central shell is fixed, a first and a second horizontal plate defining top and bottom faces within the chamber, the second plate being pierced by holes for the flow of the sodium which is distributed by the ducts formed by the bent-back and sheet-metal elements. These elements are fixed within each compartment against the central shell and the bottom horizontal plate and have two radially extending lateral portions and a horizontal central portion placed opposite to the nozzle which opens into said compartment.

In accordance with a particular feature, the lateral portions of sheet-metal elements are provided with strengthening pieces which form a small gap with the outer shell.

The central shell which forms an extension of the chamber is provided with orifices in order to provide a communication for the sodium on each side of said central shell beneath the free level.

The horizontal plate which constitutes the top face of the chamber is associated with radial strengthening members which are attached to the central shell and to the plate, said members being intended to perform the function of deflectors in order to stabilize the volume of sodium above the chamber and within the outer shell.

A more complete understanding of the invention will in any case be obtained from the following description of one particular form of construction of the steam generator under consideration and of one alternative form of construction of the distributor which is mounted within the outer shell of the generator, this description being given by way of indication and not in any limiting sense, reference being made to the accompanying drawings in which.

Figure 2:
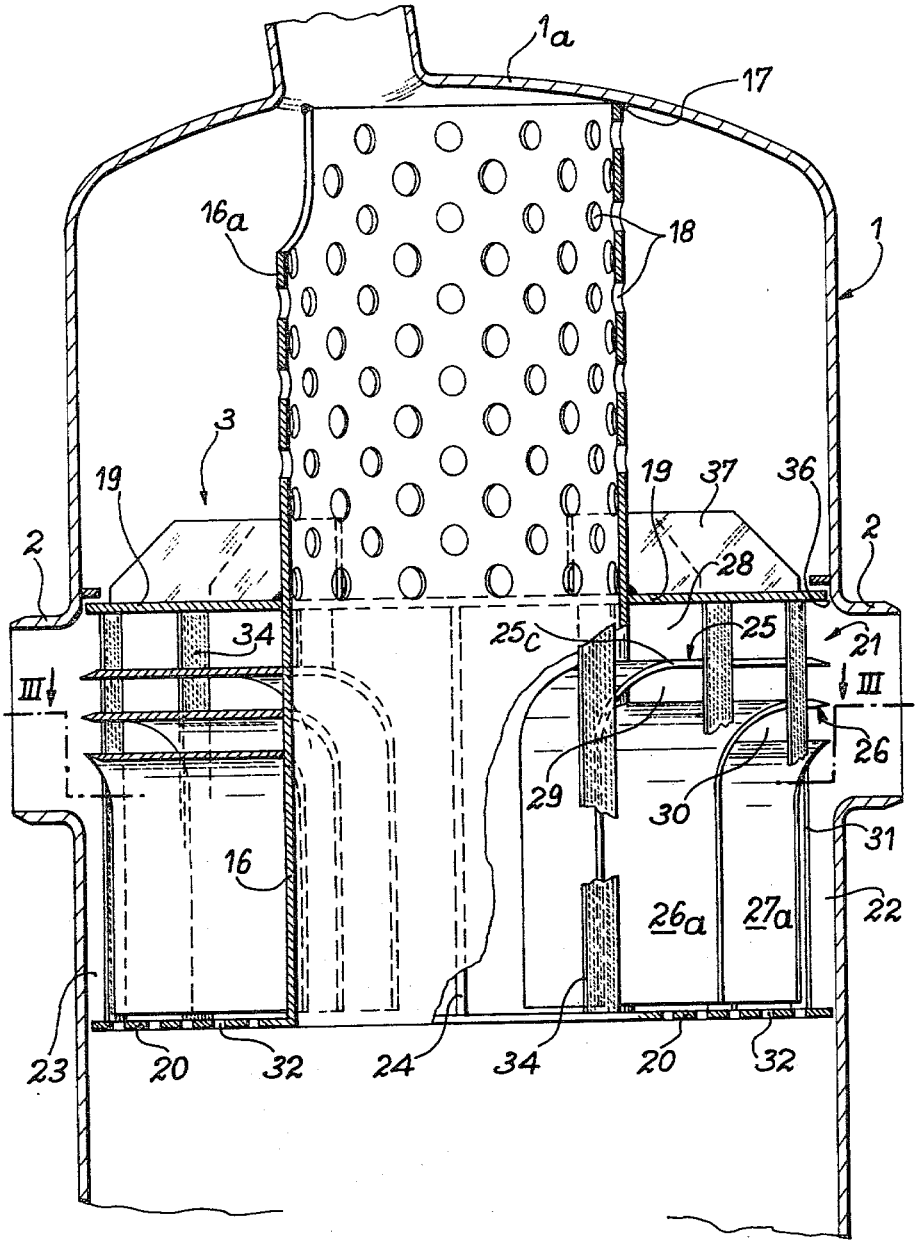
FIG. 2 is a view to a larger scale showing an alternative form of construction of the distributor.
Figure 2A:
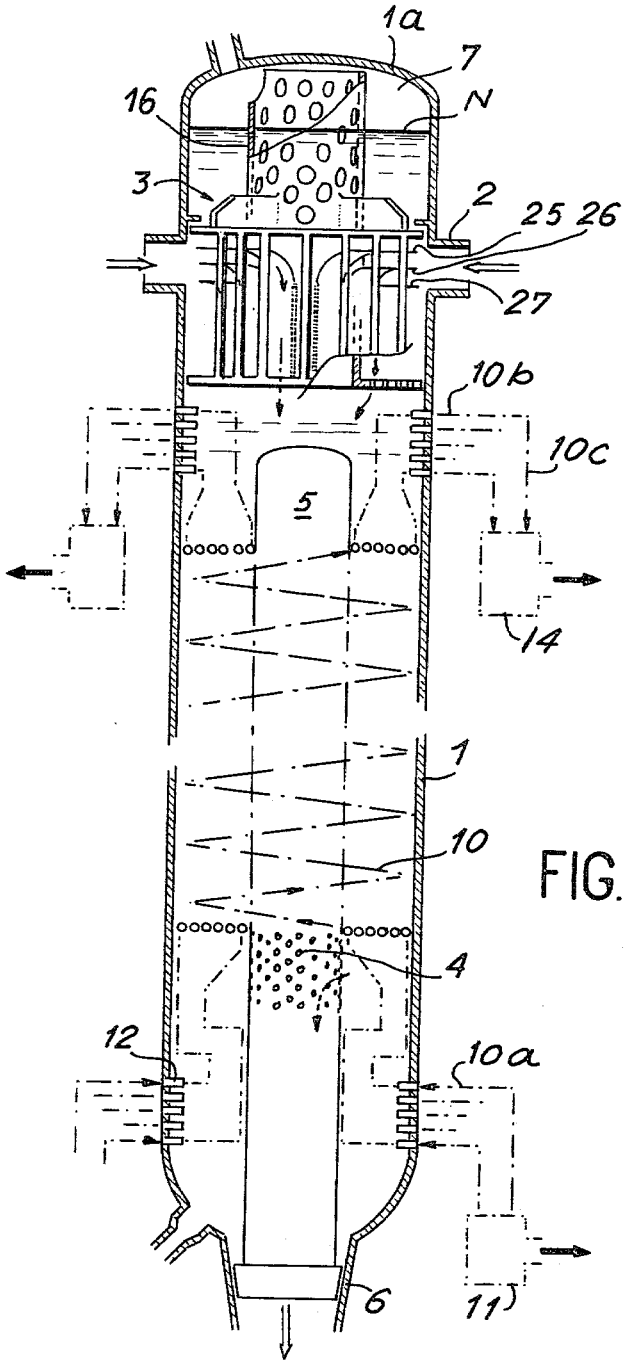
Figure 3:
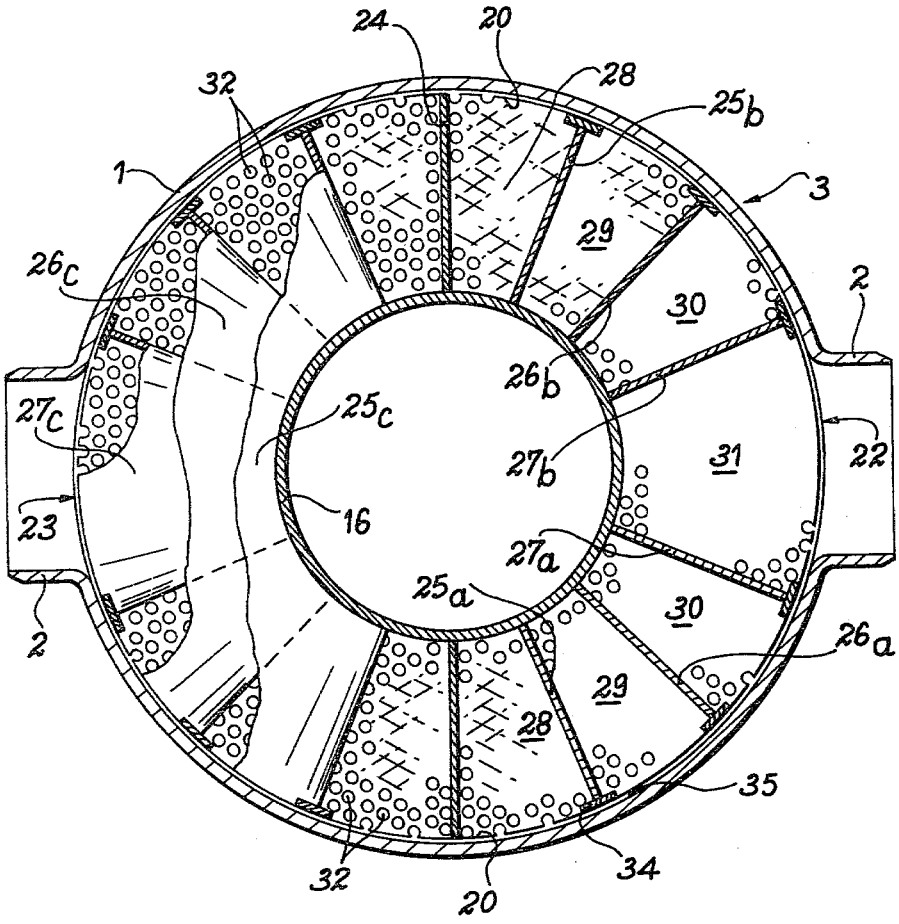

FIG. 2*a* is an alternative embodiment of a sodium-heated generator in accordance with the invention;

FIG. 3 is a sectional view taken along line III—III of FIG. 2.

Figure 1:
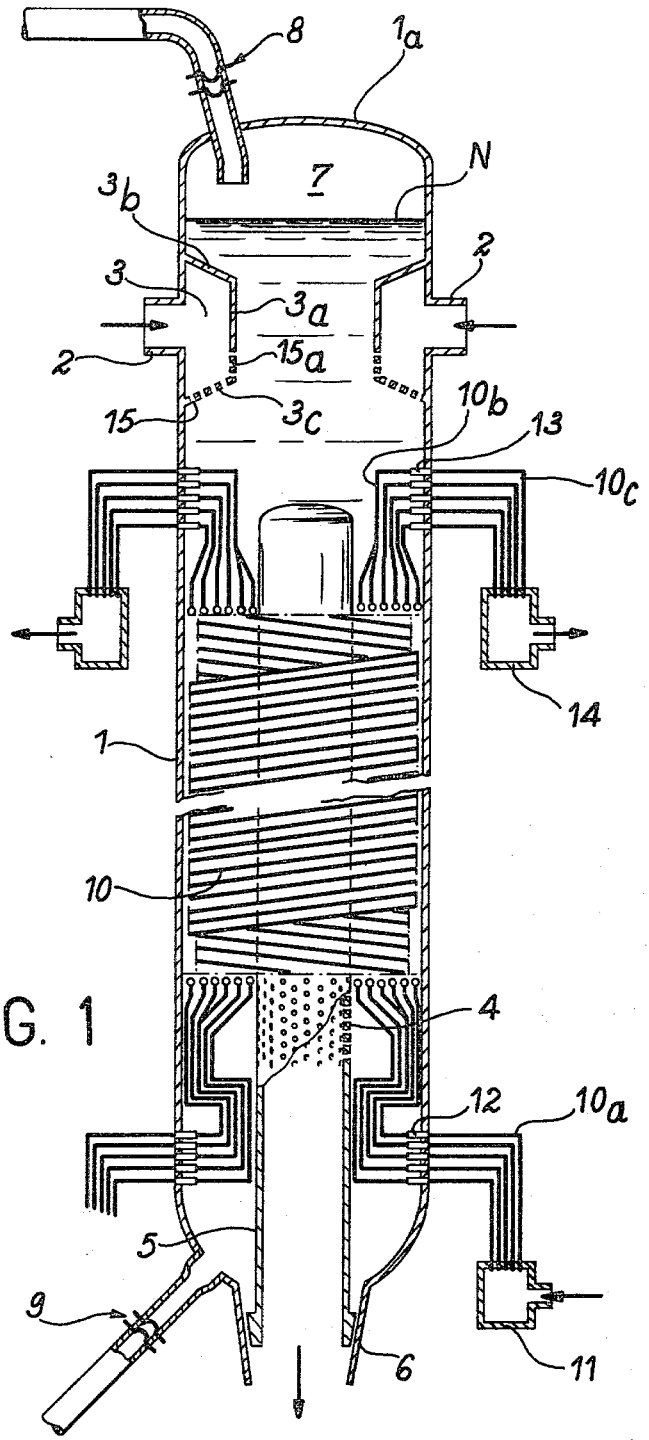
FIG. 1 is a vertical sectional view of a sodium-heated steam generator in accordance with the invention.

In FIG. 1, the outer shell 1 of the steam generator as illustrated is constituted by a cylinder of substantial length having a vertical axis. The internal space of said cylinder is supplied with liquid sodium by means of nozzles 2 which have a horizontal axis and are joined to the lateral wall of the shell 1 at the top portion of this latter. In the example shown, provision is made for two nozzles in diametrically opposite relation. Each nozzle 2 communicates with a distributor 3 which will hereinafter be described in greater detail. The liquid sodium with which the internal space of the shell 1 is almost completely filled is discharged at the lower portion of this latter by means of orifices 4 formed at the lower end of a central body 5 having the shape of a cylinder. Said central body is closed at its upper end and joined to the bottom wall of the outer shell 1 by means of a connecting device 6 which is not leak-tight and the constructional detail of which has little bearing on the present invention.

Conventional means (not shown in the drawing) serve to maintain at the top portion of the outer shell 1 a predetermined free level N of liquid sodium, an atmosphere consisting especially of argon being present above said free level so as to form a "sky" 7. The level N is established in such a manner as to ensure that the distributor 3 is continuously immersed in the liquid sodium. A safety device 8 of known type makes it possible to ensure that the argon can be discharged from the shell 1 in the event of an accidental pressure rise. By way of example, a device of this type is formed by two bursting discs mounted in a pipe 8*a* which communicates with the argon "sky" 7. A safety device 9 which is similar to the device 8 is provided at the lower end of the shell 1 in a pipe 9*a* in order to carry out the discharge of liquid sodium if necessary.

A bundle of vaporization tubes 10 is mounted within the outer shell 11 in the angular space formed between the central body 5 and the lateral wall of said shell.

Each tube 10 is supplied with water through a header 11 located outside the shell 1 at the level of the lower end of this latter. Said header 11 of annular design could be replaced by a plurality of separate headers, a bank of tubes 10 being connected to each header at the lower ends 10*a* of said tubes. Said lower ends 10*a* pass through the lateral wall of the shell 1. To this end, each tube 10 is fitted with a thermal sleeve 12 of known type for joining the outer tube-wall to the lateral wall of the shell 1 on the internal surface of this latter. Since the connecting device 6 is not leak-tight, a flow of liquid sodium has the effect of continuously washing the sleeves 12 and the adjacent portions of the tubes 10. In the example under consideration, each tube 10 has a helical configuration over the greater part of its length within the interior of the shell 1. The upper end of each tube 10 has a short substantially vertical section 10*b* followed by a horizontal section 10*c* which is oriented radially with respect to the lateral wall 1*a* of the shell 1. The section 10*c* passes through said lateral wall 1*a* by means of another thermal sleeve 13 which is similar to the sleeve 12. The tubes 10 are then connected to a steam header 14 located outside the shell 1 at the level of the upper portion of this latter. The structure of the header 14 is similar to that of the water header 11 mentioned earlier.

The tubes 10 pass through the lateral wall of the shell 1 at a number of different levels distributed over a predetermined length of the shell which should be as small as possible but remains a function of the overall length of said tubes. At a given level, these tube penetrations are uniformly spaced around the lateral wall of the shell 1.

The mean penetration level is located substantially at the height of the top end of the central body 5 and well below the level N of liquid sodium. The distributor 3 is placed in the internal space formed within the shell 1 between said level N and the top level of penetration of the tubes 10 of the bundle. In the example shown, said distributor 3 is advantageously constituted by a chamber of annular shape which is coaxial with the outer shell 1 and is supplied through the nozzles 2. In this example, said chamber has an internal cylindrical wall 3*a* extended by frusto-conical bottom and top walls 3*c* and 3*b* respectively, the ends of which are attached to the inner wall of the shell 1. The bottom wall 3*c* has a plurality of orifices 15 for establishing a communication between the chamber of the distributor 3 and the internal space of the shell 1, thus ensuring the flow of liquid sodium which is introduced into the distributor through the nozzles 2. Orifices 15*a* of the same type are also formed at the bottom of the internal wall of the chamber.

It will be clearly understood that the distributor structure which has been described in the foregoing is given solely by way of indication. It would also be possible in particular to provide a chamber of annular shape which communicates through its internal cylindrical wall with a single axial duct, said duct being intended to open into the internal space of the shell.

FIGS. 2 and 3 thus illustrate an alternative form of construction of the distributor which makes it possible to ensure better distribution of the sodium within the outer shell 1 from the inlet nozzles 2. To this end, said distributor comprises a cylindrical central shell 16 which is coaxial with the outer shell 1 and mounted within this latter. Said central shell is provided with an upper extension 16*a* and this latter is attached at 17 to the top end-wall 1*a* which closes the outer shell. The extension 16*a* of the central shell is provided with a plurality of holes 18 through which the sodium contained in the outer shell can be distributed both outside and inside said central shell, especially in dependence on any possible variations in the free level N. Two transverse plates 19 and 20 respectively which are parallel to each other and extend from said central shell to the internal wall of the outer shell 1 are fixed on the central shell 16. However, a small lateral gap 36 is formed between the transverse plates and the outer shell 1. The central shell 16 and the plates which are thus attached to this latter are accordingly permitted to move to a slight extent in order to permit any differential thermal expansion which may take place. The plates 19 and 20 delimit together with the external surface and the central shell 16 an annular chamber 21 which constitutes the distributor chamber. Said plates are so arranged that the sodium inlet nozzles 2 which are placed in coaxial and diametrically opposite relation on each side of the outer shell 1 open directly into said chamber. The chamber 21 is also divided into two adjacent compartments 22 and 23 by means of a transverse partition-wall 24 which extends at right angles to the common axis of the nozzles 2. In the same manner as the plates 19 and 20, said partition-wall 24 extends to the vicinity of the internal wall of the outer shell 1 without being attached to this latter.

Provision is made within the chamber 21 for a series of ducts which are intended to permit better distribution of the flow of sodium as this latter is admitted into said chamber from the nozzles 2. Each compartment 22 and 23 is accordingly provided with three bent-back sheet-metal elements designated respectively in the drawings by the references 25, 26 and 27. As can also be seen from the sectional view of FIG. 3, the sheet-metal element 25, for example, has two lateral portions 25*a* and 25*b* extending vertically and in a substantially radial plane which passes through the axis of the outer shell. Said portions 25*a* and 25*b* are joined together at their upper ends by means of a horizontal portion 25*c* (FIG. 2) located within the distributor chamber 21 opposite to the corresponding point of junction of the nozzle 2. In the example shown, said portion 25*c* is placed at a level which corresponds approximately to three-quarters of the diametral dimension of the nozzle 2. As in the previous case, the second sheet-metal element 26 has two radial lateral portions 26*a* and 26*b* separated respectively from the portions 25*a* and 25*b* of the first sheet-metal element by an annular interval which is equal to the interval between said portions 25*a* and 25*b* of the central partition 24. The portions 26*a* and 26*b* of the second sheet-metal element are joined together by means of a horizontal portion 26*c* which is parallel to the portion 25*c* and located beneath this latter, substantially at the level of a diametral plane which passes through the axis of the nozzle 2. Finally a similar arrangement is provided for the sheet-metal element 27, the horizontal portion 27*c* of which forms a connection between the lateral portions 27*a* and 27*b* and is placed at a point corresponding to approximately one-quarter of the diametral dimension of the corresponding nozzle 2.

In conjunction with the central shell 16, the plates 19 and 20 and the transverse partition-wall 24, the sheet-metal elements 25 to 27 thus define a series of adjacent but separate ducts or sectors for distributing the sodium flow which is introduced into each compartment 22 or 23 of the chamber 21 through the nozzles 2 at flow rates which are substantially identical from one sector to the next. At the outlet of each nozzle 2, the sheet-metal elements in fact provide four ducts which are designated respectively by the references 28, 29, 30 and 31, which have approximately the same development and in which the rate of flow through the nozzle is distributed in an approximately uniform manner. The flow rates within the ducts of the chamber are then distributed between the lateral portions of the sheet-metal elements or the transverse partition-wall 24; each sector which is delimited between said elements corresponds to 1/16 of the total transverse cross-section of the annular chamber 21, these sectors being also joined together in pairs. At the discharge ends of the ducts, the sodium passes through the bottom plate 20 which delimits the distributor chamber through a series of holes 32 formed in suitably spaced relation in said plate. It should be noted that, in order to facilitate the separation of the flow from each nozzle 2 into the ducts mentioned above, those ends of the sheet-metal elements 25 to 27 which are directed towards the nozzle can advantageously have a tapered zone 30. Moreover, in order to endow these sheet-metal elements with higher strength and rigidity, especially in their lateral portions, said portions can be provided with transverse strengthening pieces 34 (shown in FIG. 3) in such a manner as to leave a free clearance space 35 with the outer shell 1. By means of said clearance space, a communication can also be provided to a certain extent between adjacent sectors, thus further contributing to better distribution of the flow streams.

The plate 19 is provided at the top with a series of radial gusset-plates 37 which also have the effect of improving the mechanical strength of the distributor. Said radial gusset-plates additionally perform the function of deflectors for preventing rotational displacement of the mass of liquid sodium within the outer shell 1 as a result of an imbalance of the flow rather of possible leakages of the feed sodium through the gaps 36 (e.g. in the event of an extremely small relative displacement of the axes of the diametrically opposed nozzles 2), or in the event of a slight misalignment of the distributor with respect to shell 1, the free level of sodium N being always located above said deflectors.

By way of indication, the distributor which has been described in the foregoing can be constructed by means of sheet-metal elements or plates having a thickness of 15 mm, the velocity of flow of sodium through the inlet nozzles being of the order of 5 m/sec and the volume rate of flow being 2 $m^3$/sec.

It is readily apparent that the invention is not limited to the examples of construction which have been more especially described with reference to the accompanying drawings but extends on the contrary to any alternative forms.

What we claim is:

1. A steam generator comprising an outer cylindrical shell having a substantial length and vertical axis and a central cylindrical and vertical body extending over the lower part of said length; said outer shell and said central body defining an annular space within the internal space defined by said outer shell, distributing means for supplying said annular space with liquid sodium, at least one tube bundle contained within said annular space for circulating water and in heat-exchange relation with the liquid sodium and means for maintaining a predetermined free level of sodium within said internal space and an inert gas atmosphere above said free level, each tube of the tube bundle being provided with an upper end and a lower end, the upper and lower ends of the tubes being fitted with thermal sleeves for attaching the tube ends to the outer shell and passing said ends through said shell, said ends and the entire length of said tubes between said thermal sleeves being located below said free level, said distributing means being located within said internal space above the upper ends of the tubes of said bundle and below the free level of liquid sodium, so that said at least one tube bundle and its upper ends are completely immersed within said liquid sodium, said distributing means comprising at least one nozzle, and an annular chamber located within said outer shell and above said at least one tube bundle, said chamber being fixed against said outer shell, said chamber including a horizontal bottom annular plate provided with evenly distributed holes, said annular plate extending substantially over the annular space so as to distribute evenly said liquid sodium to said annular space.

2. A steam generator according to claim 1, wherein the tube ends of the bundle pass through the lateral wall of the outer shell at a number of different levels.

3. A steam generator according to claim 2, wherein the annular chamber has an internal cylindrical wall in coaxial relation with the outer shell and extending by frustoconical bottom and top walls fixed against the outer shell, the bottom wall and the base of the cylindrical wall being provided with orifices for the flow of liquid sodium.

4. A steam generator according to claim 1, wherein the annular chamber of the distributor is supplied through two independent and diametrically opposite nozzles having a common horizontal axis and having their openings respectively in two adjacent compartments formed within the chamber on each side of a vertical transverse partition-wall which contains the axis of the outer shell and extends at right angles to the nozzles aforesaid, each compartment being in turn divided into a plurality of adjacent sectors delimited by bent-back sheet-metal elements attached to the distributor and arranged in pairs with the chamber opposite to the nozzle which opens into a compartment so as to form separate ducts for the distribution of the sodium flow.

5. A steam generator according to claim 4, wherein the distributor chamber has a cylindrical central shell in coaxial relation with the outer shell and provided with an upward extension limited by a top end-wall which closes said outer shell and against which said central shell is fixed, a first and a second horizontal plate defining top and bottom faces within the chamber, said second plate being pierced by holes for the flow of the sodium which is distributed by the ducts formed by the bent-back sheet-metal elements aforesaid.

6. A steam generator according to claim 5, wherein the sheet-metal elements are fixed within each compartment against the central shell and the bottom horizontal plate and have two radially extending lateral portions and a horizontal central portion placed opposite to the nozzle which opens into said compartment.

7. A steam generator according to claim 6, wherein the lateral portions of sheet-metal elements are provided with strengthening pieces which form a small gap with the outer shell.

8. A steam generator according to claim 4, wherein the central shell which forms an extension of the chamber is provided with orifices in order to provide a communication for the sodium on each side of said central shell beneath the free level.

9. A steam generator according to claim 5, wherein the horizontal plate which constitutes the top face of the chamber is associated with radial strengthening members which are attached to the central shell and to the plate, said members being intended to perform the function of deflectors in order to stabilize the volume of sodium above the chamber and within the outer shell.

* * * * *